US008425688B2

(12) United States Patent
Laffitte et al.

(10) Patent No.: US 8,425,688 B2
(45) Date of Patent: Apr. 23, 2013

(54) PROCESS FOR ACIDIC CLEANING IN THE BEER INDUSTRY

(75) Inventors: Jean-Alex Laffitte, Pau (FR); Bernard Monguillon, Salies de Bearn (FR); Pierre Stachura, Courcelles (BE)

(73) Assignee: Arkema France, Colombes (FR)

( * ) Notice: Subject to any disclaimer, the term of this patent is extended or adjusted under 35 U.S.C. 154(b) by 0 days.

(21) Appl. No.: 12/270,937

(22) Filed: Nov. 14, 2008

(65) Prior Publication Data

US 2009/0139546 A1 Jun. 4, 2009

Related U.S. Application Data

(60) Provisional application No. 60/988,149, filed on Nov. 15, 2007.

(30) Foreign Application Priority Data

Nov. 15, 2007 (FR) ..... 07 59056
Nov. 30, 2007 (FR) ..... 07 59474

(51) Int. Cl.
*B08B 9/08* (2006.01)
*B08B 3/08* (2006.01)
*B08B 7/04* (2006.01)

(52) U.S. Cl.
USPC ..... 134/22.19; 134/22.17; 134/28; 134/29

(58) Field of Classification Search ..... 134/22.17, 134/22.19, 28, 29; 510/218, 492, 505
See application file for complete search history.

(56) References Cited

U.S. PATENT DOCUMENTS

| | | | | |
|---|---|---|---|---|
| 3,449,164 | A * | 6/1969 | Janos et al. | 134/3 |
| 4,923,523 | A * | 5/1990 | Schluessler | 134/25.3 |
| 2004/0173244 | A1 * | 9/2004 | Strothoff et al. | 134/25.2 |
| 2006/0035808 | A1 | 2/2006 | Ahmend et al. | |
| 2006/0042665 | A1 * | 3/2006 | Fernholz et al. | 134/42 |

FOREIGN PATENT DOCUMENTS

WO WO 2005073359 A1 * 8/2005

* cited by examiner

*Primary Examiner* — Michael Kornakov
*Assistant Examiner* — Natasha Campbell
(74) *Attorney, Agent, or Firm* — Smith, Gambrell & Russell, LLP

(57) ABSTRACT

The present invention relates to the acidic cleaning in the beer industry, and more particularly an improved process for acidic cleaning of the various elements and vessels that are used in the preparation of beer and other related fermented beverages, said cleaning being carried out by using a formulation comprising at least one alkane sulphonic acid.

7 Claims, No Drawings

PROCESS FOR ACIDIC CLEANING IN THE BEER INDUSTRY

The present invention concerns a process for acidic cleaning in the beer industry, and more particularly an improved process for acidic cleaning of the various elements and vessels that are used in the preparation of beer and other and other related fermented beverages.

It should be first recalled that the process for the preparation of beer is usually conducted in four successive steps:

1. brewing: this step consists in mixing the cereals (barley, malt (germinated barley), corn, rice) with hot water (with stages of temperature from 40° C. to 100° C.) and aromatics such as hop and possibly of various and varied spices. This step makes it possible to extract sugars and proteins from cereals to form what is called wort (or must);

2. filtration: the so obtained must is filtered to yield on the one side the so called cooled clarified wort and on the other side the insoluble solid residues of cereals called draff;

3. fermentation: the cooled clarified wort is introduced in the fermentation tank (or fermentor, generally a cylindro-conical reactor) called FVT. Yeast is added and the whole macerates during three to seven days at a temperature of between 6 and 10° C. This step transforms glucose and sugars into ethanol and carbon dioxide.

4. guard: at the end of fermentation, the mixture undergoes a cold shock at 3° C. to allow yeasts and proteins to coagulate. This step takes place either in the fermentor or in another tank. The so obtained beer is left for maturation in the guard reactor and then filtered.

After these four preparation steps, the beer is conditioned into barrels, bottles or even beer cans.

During the fermentation step (step 3), a yeast ring is often formed at the interface gas phase/liquid phase. The yeast ring mainly comprises organic insoluble species: yeast residue, cell wall residues, insoluble sugars.

Moreover, beer stones are generally formed at the bottom of the fermentor and on its walls. Beer stones mainly consist of calcium oxalate and various organic species.

Consequently, the fermentor is often soiled by two types of quite distinct stains: organic stains (mainly yeast ring) and inorganic stains (mainly beer stones).

However, one major aspect in the preparation of beer or other related fermented beverages, is to have barrels, containers, fermentors, drains and other devices for transporting or safe-guarding the liquids used in the preparation of the aforesaid beers and other related fermented drinks, which are absolutely clean and in particular free from any trace of organic and inorganic stains. Indeed, such stains could generate the presence and the growth of bacteria or any other harmful elements to the prepared products, and even make them unsuitable to consumption.

In order to avoid organic and inorganic stains, each reactor (and more generally vessel, container, drains, and the like) undergoes a washing, either in basic medium or in acidic medium depending on the specific step for the preparation of beer. The washing of the various elements of the brewery installation used for the preparation of beer is usually carried out according to the following steps:

A) Brewing reactor: basic medium washing with sodium hydroxide;

B) Fermentation vessel containing organic and inorganic stains: mixed washing in 3 steps:

1. Pre cleaning called "one way" washing (direct elimination at the station) with clear water (elimination of 10% of the stains), or in the presence of diluted soda (elimination of 80-90% of the stains) in the form of a fast "shot", which allows a better elimination of the stains. Sodium hydroxide can however not be used in great quantity because the fermentation tank contains carbon dioxide likely to react with the sodium hydroxide which could involve the implosion of the tank by depression;

2. Cleaning using phosphoric acid (generally at 1.5% vol. of a solution with 56% by weight of phosphoric acid); and 3. Disinfection using a mixture of a low content of sulphuric acid together with a biocide.

At the present time, washing steps 2 and 3 are carried out in a successive way using two different acids, each one being effective for elimination of one type of stain:

phosphoric acid is used to clean the yeast ring;

sulphuric acid is used to clean the beer stones, phosphoric acid being ineffective with respect to this type of stain (calcium oxalate). The use of the sulphuric acid is not however without disadvantage because of its corrosive capacity. This effect of corrosion can however be mitigated while working at low temperature.

C) Guard: this very step generally comprises less stain than in the fermentor and in particular little or no yeast ring; consequently a simple cleaning with water followed by a cleaning with the mixture sulphuric acid+biocide as indicated above is generally carried out.

In addition, the barrels are hot cleaned (typically about 80° C.) by means of phosphoric acid, sulphuric acid that is too corrosive at this temperature, as indicated supra.

It must moreover be understood that between each cleaning step, a rinsing with clear water is carried out.

Thus, a first objective of the present invention consists in a process of cleaning of the installations used in the manufacture and the storage of beer, which is more easy and more rapid to carry out, compared to those currently used.

Another objective of this invention consists in a simple and effective process allowing at the same time an effective cleaning of the beer stones and yeast rings.

Still another objective is a process of cleaning of the installations used at the time of the preparation and storage of beer and other related fermented drinks, by means of a single formulation allowing the elimination of all the types of stains, in particular beer stones and yeast rings.

Other advantages will appear in the description of this invention, which is set out below.

It has now been discovered, in a completely surprising way, that it is possible to carry out a complete and effective cleaning of installations used for the manufacture of beer by using a formulation based on alkane sulphonic acid.

It has indeed been evidenced that a formulation based on alkane sulphonic acid allows at the same time the elimination of the yeast ring (usually eliminated by using phosphoric acid) and the elimination of the beer stones (usually eliminated by using sulphuric acid).

Thus, the use of a formulation based on alkane sulphonic acid makes it possible to avoid the use of several cleaning formulations, such as a formulation based on phosphoric acid and a formulation based on sulphuric acid. The use of a formulation based on alkane sulphonic acid can also make it possible to avoid several successive washing operations and also several intermediate rinsings.

The advantages are thus mainly a saving of time, costs, productivity, energy, as well as a reduction in the number of cleaning chemicals present on the site of manufacture.

In addition, the usually used phosphoric acid is discharged in the form of phosphates, which can harm the environment, and the increasingly severe environmental standards aim at proscribing such phosphate discharges.

Thus, a first object of the invention consists in a process for cleaning of an installation used in the preparation of beer, or other related fermented beverages, comprising the steps of:

a) optional pre-washing of the installation;

b) washing of the installation by circulation in said installation of an effective quantity of a formulation comprising at least one alkane sulphonic acid; and c) rinsing of said installation by circulation of a rinsing solution.

Thus, the process of the invention makes it possible on the one hand to reduce the number of cleaning steps, and on the other hand to reduce the number of acid formulations used, from two (acid phosphoric and acid sulphuric) to only one cleaning formulation of stains.

Moreover, the formulation used in the process of the invention being less corrosive than sulphuric acid, this one may be used for the hot cleaning of barrels.

More particularly, the process of the present invention relates to the cleaning of installations used for the preparation and the storage of beer and other related fermented beverages.

In the present description and claims, "installation" means the various elements commonly used in breweries, and in particular tanks, vessels, barrels, fermentors, drains, valves, bottles, beer cans, and the like, i.e. all the elements likely to come into contact with beer and others liquids or solids necessary to its preparation.

The materials of the various components of the installation are generally selected among stainless steel, aluminium, copper, brass, steel coated or not, for example by an epoxy resin, plastic materials, in particular polypropylene, polyethylene, poly(vinyl chloride), glass, and the like.

According to a preferred embodiment, the materials used for the installations of brewery are selected from among stainless steel of the grade 304L or 316L, aluminium, and epoxy resin-coated steel.

It must be understood that the process of the invention applies to the whole or only to one or more parts of the installation used for the preparation of beer or other related fermented beverages. In present description and claims, the term "installation" indicates the whole of the installation or one or more parts only of the installation.

The process according to the present invention includes an optional first step of preliminary wash, intended to eliminate, in a mechanical way, the largest part of the impurities. This pre-wash is carried out by water circulation, alone or in combination with "shots" of an alkaline solution, preferably diluted, for example an aqueous solution of sodium or potassium hydroxide. "Shot" means sending in the part of the installation to be cleaned an alkaline solution, generally slightly concentrated that is allowed to react act during a short time. By "short time" is meant a period ranging from a few seconds to several minutes, even a few hours.

After the optional pre-wash step, the washing of the installation is carried out by circulation of a formulation comprising at least one alkane sulphonic acid.

In the present description and claims, alkane sulphonic acid is to be understood as preferably being acids chosen from among alkane sulphonic acids having a saturated, linear or branched hydrocarbon chain, of from 1 to 4 carbon atoms. Alkane sulphonic acids that may be used in the process of the present invention are particularly chosen from among methane sulphonic acid, ethane sulphonic acid, n-propane sulphonic acid, iso-propane sulphonic acid, n-butane sulphonic acid, iso-butane sulphonic acid, sec-butane sulphonic acid, tert-butane sulphonic acid, and mixtures of two or several of any of them, in all proportions.

According to a preferred embodiment, the alkane sulphonic acid used in the process of the present invention is methane sulphonic acid or ethane sulphonic acid, and in a most preferred embodiment the acid used is methane sulphonic acid.

Thus, the formulation of cleaning comprising at least one alkane sulphonic acid for use in the process of the invention comprises one or more alkane sulphonic acids with linear or branched hydrocarbon chain comprising from 1 to 4 carbon atoms, and preferably comprises at least methane sulphonic acid (AMS).

Generally, the formulation comprises from 0.1 to 100 weight % of alkane sulphonic acid, more generally from 0.5 to 90 weight %, particularly from 0.5 to 20 weight % of alkane sulphonic acid, and more particularly from 0.5 to 5 weight % of alkane sulphonic acid.

The formulation is generally an aqueous formulation that can be prepared in the form of concentrated mixture, which is diluted by the end-user. Alternatively, the formulation may also be a ready-to-use formulation, i.e. which does not need to be diluted. One can for example use a 70-weight % methane sulphonic acid solution in water, sold by the Arkema company under the Trade name Scaleva™, ready-to-use or diluted with water, in the above-indicated proportions.

In addition to the alkane sulphonic acids, the cleaning formulation can possibly comprise one or more rheological additives, solvents, biocides and other texture agents, selected among solvents and co-solvents, organic or inorganic acids (for example sulphuric, phosphoric, nitric, sulphamic, citric acids), thickening agents, surface-active agents, foaming agents, anti-foaming agents, and the like, well known by the skilled in the art.

It was discovered that the alkane sulphonic acids such as those described above are effective to clean the stains present or formed in the installations used for the preparation of beer and other related fermented beverages.

The use of alkane sulphonic acids thus makes it possible to eliminate the stains, such as carbohydrates, greases, protein, mineral inorganic such as calcium carbonates, calcium phosphates, and other types of scale including oxalates, sulphates, hydroxides and/or sulphides, whether or not in association with various organic and/or metallic compounds, metalloids, alkaline or alkaline-earth compounds, and other residues present or generated during the preparation of beer or other related fermented beverages.

Alkane sulphonic acids are particularly effective to eliminate the residues of both types known as beer stones and yeast rings as previously indicated.

The washing (or cleaning) of all or part(s) of the installation is carried out by circulation of an effective amount of a formulation comprising at least one alkane sulphonic, as depicted above.

"Effective amount" means an amount allowing the elimination of all the stains, which, if they are not correctly eliminated, could lead to the development of bacteria. The process of the present invention can eliminate all types of stains, and consequently the bacteria which could be harmful towards the preparation, conservation, savour, texture, and non-toxicity for the human being, of beer or other related fermented beverages prepared in the installation and stored in barrels, bottles, beer cans and others.

This amount can vary in great proportions, according to the volume of the installation to be cleaned, the nature and the quantity of stains which one wishes to eliminate, of the temperature and the pressure of the formulation used, and the like.

Generally, an effective amount of the cleaning acid formulation is put in circulation in the installation, this circulation being established for a sufficient time to allow the complete elimination of the stains.

A visual test of the installation, or a measurement of the bacteriological activity within the installation according to traditional techniques known by the one skilled in the art, makes it possible to determine the effective amount of formulation to be used use and the duration of circulation of the aforementioned formulation necessary to the complete elimination of the stains.

Thus, the amount of formulation and the duration of circulation will be established to allow a complete elimination of the stains, while observing at the same time a minimal amount of formulation (primarily for economical and environmental reasons) and the shortest possible duration of circulation (also primarily for economical reasons).

Acidic cleaning with the afore-mentioned formulation comprising at least one alkane sulphonic acid as previously described can be carried out at any temperature, generally ranging between 0° C. and 100° C., more generally between 5° C. and 40° C., typically between 5° C. and 20° C. in the fermentor or the storage vessel, and between 60° C. and 80° C. in the conditioning containers (barrels, bottles or beer cans) used for beer or other related fermented beverages.

After the acidic washing step using the formulation comprising at least one alkane sulphonic acid, the installation is advantageously rinsed by circulation of a rinsing solution, for example with water, as commonly carried by the skilled in the art.

Thanks to the process of the invention, the washing of an installation used for the preparation of beer or other related fermented beverages is carried out in only one stage of acidic washing, contrary to the techniques known today. This single stage of acidic washing makes it possible to eliminate in particular the beer stones as well as the yeast rings formed during manufacture of the aforesaid beers and other related fermented beverages.

According to another object, the present invention relates to the use of a formulation comprising at least one alkane sulphonic acid, in particular at least methane sulphonic acid, for the elimination of organic and inorganic stains, such as carbohydrates, greases, protein, inorganic compounds such as calcium carbonates, calcium phosphates, and other types of scale including oxalates, sulphates, hydroxides and/or sulphides, whether or not in association with various organic and/or metallic compounds, metalloids, alkaline or alkaline-earth compounds, and other residues present or generated during the preparation of beer or other related fermented beverages.

More particularly, the invention relates to the use of a formulation comprising at least one alkane sulphonic acid, in particular at least acid methane sulphonic acid, for the elimination of beer stones and yeast rings formed during the preparation and/or of the storage/conservation of beer or other related fermented beverages.

By "other related fermented beverages" is meant any type of beverages such as for example wine, cider, whisky, sake, and more generally any type of alcoholic drinks whose manufacturing process involve yeast or any other aerobic fermentation medium likely to release carbon dioxide.

The present invention is further illustrated by means of the following examples, without them presenting any restrictive character, and which cannot be consequently understood to restrict the scope of protection defined in the annexed claims.

EXAMPLE 1

Cleaning of Stains from an Industrial Wort a) Standard Stain Creation Step During Fermentation:

Into a cylindro-conical tank of 74 cm×18 cm of body and a length of cone of 17 cm made of stainless steel (volume 316 L), are introduced 5 L of clarified cooled wort of brewery at ambient temperature (between 15 and 25° C.).

Beer yeast (*Saccharomyces cerevisae*) is then introduced by respecting the necessary amount of living yeast (50 mL of liquid yeast for 15 L of wort), so as to reproduce industrial conditions.

Fermentation takes place at ambient temperature (between 15 and 25° C.) during 6 days. After 6 days, the tank is emptied out.

In conformity with the industrial practice, a yeast ring (yeast associated with organic stains) is observed at the liquid/air interface at the top of the cylindro-conical tank.

The repeatability of formation of stains was evaluated on a plurality (about thirty) of fermentations controls and makes it possible to guarantee a level of stain representative of the practice and a satisfactory reproducibility.

b) Pre-Wash Step

A pre-wash is carried out by circulation of 3 times 5 seconds of a 1.5% alkaline solution of sodium hydroxide, with a 5 minutes' pause between each circulation.

c) Acidic Washing Step

The cleaning of the stain is carried out via the circulation of a cleaning formulation under stable and controlled hydrodynamic conditions, by the intermediary of a fixed sprinkling ball (Hacke Mark, standard M1-1 DN8) located on the upper part of the tank. More particularly, circulation is set to 1400 L/min and the pressure of sprinkling is of 0.2 relative bars (1.2 absolute bars), the solution being maintained at ambient temperature (between ° C. and 25° C.) until total disappearance of the stains. Every 5 minutes, circulation is stopped in order to visually check the disappearance of the stains in the tank. Cleaning is estimated is visually and the necessary time for obtaining an obviously clean tank is thus established.

For each experimental condition, the test is at least replicated 6 times (2 fermentations in 3 distinct sequences of fermentation).

Moreover, in order to assert the relative comparison of the cleaning tests, a cleaning reference formulation is systematically placed in the sequence of tests, a comparison being established between two tanks. This cleaning reference formulation being a 1.5% vol. aqueous solution 56 weight phosphoric acid.

Acidic formulations used in the tests are as follows:

Reference Formulation A: phosphoric acid ($H_3PO_4$) @ 56% by weight in water (d=1.38, i.e. 1.15% by weight of pure $H_3PO_4$).

Formulation 1 (comparative): 55% formic acid in water (d=1.195 i.e. 0.98% by weight of pure formic acid).

Formulation 2 (according to the invention): 1% by volume in water of methane sulphonic acid @ 70% by weight (d=1.35, i.e. 0.94% by weight of pure methane sulphonic acid).

Table 1 below shows the additional or lower periods of time, expressed in minutes, necessary to the visually assessed total elimination of the stains, compared to a cleaning carried out with Reference Formulation A (1.15% by weight of phosphoric acid).

TABLE 1

| Cleaning Formulation | Additional or lower period of time in minutes as compared to the Reference Formulation A |
|---|---|
| Reference Formulation A (1.5 vol. %) | 0 |
| Formulation 1 (1.5 vol. %) | +30 |
| Formulation 2 (1.5 vol. %) | −10 |

It is observed that Formulation 2 according to the invention allows a saving of 40 minutes of time compared to another acidic formulation (formic acid) and even 10 minutes of time compared to the reference formulation (phosphoric acid).

EXAMPLE 2

Cleaning of Stains from a Reconstituted Wort

The reconstituted wort is obtained by dilution of a commercially available kit for beer preparation sold under the name "Brewferm": wheat-based white beer).

The wort is reconstituted in accordance with the manufacturer's instructions: dilution of the wort concentrate (1 L) in 14 L of cold water and addition of 750 g sugar. The freeze-dried yeast sachet included in the kit is added to the reconstituted wort right before the fermentation step.

Contrary to industrial wort, the initial level of stain is lower with reconstituted wort and the step of preliminary wash is not necessary; one thus carries out directly acidic cleaning, as in step c) of example 1.

As for table 1, table 2 below shows the additional or lower periods of time expressed in minutes, that are necessary to the elimination of the stains, compared to the Reference Formulation (1.15 weight % of phosphoric acid).

TABLE 2

| Cleaning Formulation | Additional or lower period of time in minutes as compared to the Reference Formulation A |
|---|---|
| Reference Formulation A (1.5 vol. %) | 0 |
| Formulation 1 (1.5 vol. %) | +15 |
| Formulation 2 (1 vol. %) | −10 |

Here again, one notes a reduction in the duration of cleaning necessary to the elimination of the stains, when carried out with the acidic formulation according to the invention (Formulation 2).

EXAMPLE 3

Cleaning of Beer Stone Type Stains

Two representative samples of beer stones are collected in a brewery on fermentation tanks and subjected to the following experimentation:

- Precise weighing of approximately 0.5 grams of deposits dried beforehand with air during 24 hours at 40° C.;
- Immersion, without agitation, in the test formulation at ambient temperature (between 15° C. and 25° C.) during 4 hours,
- Filtration of the liquid solution and recovery of the non-dissolved solid.

This solid residue is dried during 24 hours at 40° C., then weighed.

Table 3 here-below shows the average percentage of dissolved beer stones on two samples for each cleaning formulation used:

Reference Formulation A: phosphoric acid ($H_3PO_4$) @ 56% by weight in water (d=1.38, i.e. 1.15% by weight of pure $H_3PO_4$).

Reference Formulation B: sulphuric acid ($H_2SO_4$) @ 78% (density=1.7, i.e. 1.32 weight % of pure product).

Formulation 1 (comparative): 55% formic acid in water (d=1.195 i.e. 0.98% by weight of pure formic acid).

Formulation 2 (according to the invention): 1% by volume in water of methane sulphonic acid @ 70% by weight (d=1.35, i.e. 0.94% by weight of pure methane sulphonic acid).

TABLE 3

| Cleaning Formulation | Average % of dissolved beer stones on the two deposits |
|---|---|
| Reference Formulation A (1.5 vol. %) | 5 |
| Reference Formulation A (1 vol. %) | 65 |
| Formulation 1 (1 vol. %) | 5 |
| Formulation 2 (1 vol. %) | 55 |

It is observed that the formulation based on methane sulphonic acid has an effectiveness as regards the elimination of yeast ring similar to the one obtained with a formulation based on phosphoric acid, as well as a similar effectiveness with that of sulphuric acid, in terms of elimination of the beer stones.

Thus the process of the invention makes it possible to avoid two acidic cleaning steps (phosphoric acid and sulphuric acid) such as until now recommended, and shows that only one cleaning formulation comprising at least one alkane sulphonic acid is effective for the elimination of both the beer stones and the yeast rings.

EXAMPLE 4

Effectiveness of Calcium Oxalate Dissolution

Calcium oxalate (6 g) is added to 100 g of a methane sulphonic acid solution (4 g/L and 12 g/L) on the one hand and to 100 g of a phosphoric acid solution (4 g/L and 12 g/L) on the other hand, during 24 hours at 70° C.

The solution is then filtered and the filtrate is analysed for dosage by spectrometry ICP of the amount of calcium ions present in the solution. The results are presented in the following Table 4

TABLE 4

| Acid | Amount of $Ca^{2+}$ ions in the solution (mg/L) |
|---|---|
| Phosphoric acid 4 g/L | 20 |
| Phosphoric acid 12 g/L | 75 |
| Methane sulphonic acid 4 g/L | 80 |
| Methane sulphonic acid 12 g/L | 355 |

These results show that methane sulphonic acid is much more effective than phosphoric acid for dissolving calcium oxalate.

The invention claimed is:

1. A process for cleaning organic and inorganic stains, which result from yeast fermentation, in an installation used in the preparation of beer or other related fermented beverages, consisting of the steps of:

a) pre-washing of the installation with an aqueous solution of sodium hydroxide or potassium hydroxide;

b) washing of the installation in a single washing step by circulation in said installation of an effective quantity of an aqueous cleaning solution consisting of methane sulphonic acid and an additive selected from the group consisting of rheological additives, solvents, biocides, texture agents, co-solvents, thickening agents, foaming agents, anti-foaming agents and mixtures thereof; and c) rinsing of said installation by circulation of a rinsing solution.

2. The process according to claim 1, wherein the installation comprises one or more elements chosen from among tanks, vessels, barrels, fermentors, drains, valves, bottles or beer cans.

3. The process according to claim 1, wherein the washing of the installation by circulation is carried out at a temperature ranging between 0° C. and 100° C. in a fermentor.

4. The process according to claim 1, wherein the washing of the installation by circulation is carried out at a temperature ranging between 5° C. and 40° C. in a fermentor.

5. The process according to claim 1, wherein the washing of the installation by circulation is carried out at a temperature ranging between 5° C. and 20° C. in the fermentor.

6. The process according to claim 1, wherein the washing of the installation by circulation is carried out at a temperature ranging between 60° C. and 80° C. in barrels, bottles or cans.

7. A process for cleaning organic and inorganic stains, which result from yeast fermentation, in an installation used in the preparation of beer or other related fermented beverages, consisting of the steps of:

a) pre-washing of said installation using a dilute alkaline solution of sodium hydroxide or potassium hydroxide;

b) washing of said installation in a single step by circulating in said installation of an aqueous cleaning solution consisting of methane sulphonic acid cleaning agent and an additive selected from the group consisting of rheological additives, solvents, biocides, texture agents, co-solvents, thickening agents, foaming agents, anti-foaming agents and mixtures thereof; and c) rinsing said installation by circulating water.

* * * * *